US006427274B1

(12) United States Patent
Abbott

(10) Patent No.: US 6,427,274 B1
(45) **Date of Patent: *Aug. 6, 2002**

(54) PAINTER'S TOOL

(76) Inventor: Phillip G. Abbott, 819 Mimosa Heights Dr., Louisville, TN (US) 37777

( * ) Notice: Subject to any disclaimer, the term of this patent is extended or adjusted under 35 U.S.C. 154(b) by 0 days.

This patent is subject to a terminal disclaimer.

(21) Appl. No.: 09/691,938

(22) Filed: Oct. 19, 2000

(51) Int. Cl.[7] ..... B44C 7/00
(52) U.S. Cl. ..... 7/105; 7/165; D8/14; 15/105
(58) Field of Search ..... 7/105, 165, 156, 7/167; 15/105, 236.03; D8/14

(56) References Cited

U.S. PATENT DOCUMENTS

| | | | | | |
|---|---|---|---|---|---|
| 4,324,018 | A | * | 4/1982 | Olsson | 15/236.03 |
| 4,524,514 | A | | 6/1985 | Mallalieu et al. | |
| 4,553,279 | A | * | 11/1985 | Gassew et al. | 7/105 |
| 4,747,173 | A | * | 5/1988 | Marceau | 7/156 |
| 4,967,436 | A | * | 11/1990 | Russell | 7/156 |
| 5,222,265 | A | * | 6/1993 | Hermansson | 7/156 |
| 5,251,352 | A | * | 10/1993 | Cullison | 7/105 |
| 5,272,782 | A | * | 12/1993 | Hutt | 15/105 |
| 5,546,625 | A | * | 8/1996 | Mealey | 15/105 |
| 5,870,786 | A | * | 2/1999 | Papadopoulos | 7/105 |
| 5,956,788 | A | | 9/1999 | Henke | |
| 5,979,058 | A | | 11/1999 | Henke | |
| 6,009,581 | A | * | 1/2000 | Davis et al. | 7/105 |
| D445,320 | S | * | 7/2001 | Abbott | D8/14 |

* cited by examiner

*Primary Examiner*—James G. Smith
(74) *Attorney, Agent, or Firm*—Pitts & Brittian, P.C.

(57) ABSTRACT

A painter's tool providing multiple functions is disclosed for a painter's use in preparing a surface for painting, for opening containers, and for cleaning utensils. The tool includes a blade connected to a handle, with the distal end of the blade having a beveled edge bounded by a first squared corner and a second pointed corner. The blade includes a first side having a plurality of teeth along the first side, with the first edge extending outwardly at an angle from the handle toward the squared corner, thereby allowing ergonomic gripping of the handle while cleaning a brush or gouging with a blade corner. The blade includes an arcuate second side having an inwardly curved mid-portion for cleaning a paint roller, the curved mid-portion being bounded by two opposed notches recessed into the second side of the blade. The second side further includes a projection proximal the handle end of the blade. The painter's tool provides a plurality of elements having multiple functions oriented in an ergonomic arrangement in one hand-held tool that reduces a painter's need to carry additional tools while painting.

21 Claims, 4 Drawing Sheets

PAINTER'S TOOL

CROSS-REFERENCE TO RELATED APPLICATIONS

This application in part discloses and claims subject matter disclosed in the earlier filed pending U.S. Design Application, Ser. No. 29/129,229, filed on Sep. 7, 2000, and the earlier filed pending U.S. Application, Ser. No. 09/637,976, filed on Aug. 11, 2000.

STATEMENT REGARDING FEDERALLY SPONSORED RESEARCH OR DEVELOPMENT

Not Applicable.

BACKGROUND OF INVENTION

1. Field of Invention

The invention relates to a tool for painters. More specifically, the invention relates to an apparatus having a combination of uses for assisting a painter.

2. Description of the Related Art

Prior devices have provided a variety of shapes of tools that are utilized by painters in painting operations to assist with tasks such as scraping, spreading, cutting, opening paint cans, pulling nails, and similar tasks. In general, prior tools include a blade end for scraping paint, a nail puller hole in the blade, and a handle for manipulating the blade end. Prior tools can include foldable blades, or fixed blades in varying lengths to extend the reach of the painter without being cumbersome to carry in a pocket or a belt worn by the painter.

An example of the prior art is U.S. Pat. No. 5,979,058, issued to Henke, which discloses a multi-purpose hand tool for use by a painter for scraping and spreading putty, and cutting or sawing surfaces to be painted. The hand tool lacks a curved surface for cleaning paint rollers, and lacks an elongated, convoluted side for cleaning paint brushes, therefore requiring the painter to carry additional tools for completion of a repetitive painting activity related to cleaning painting utensils.

A further example of the prior art is U.S. Pat. No. 5,870,786, issued to Papadopoulos, which discloses a utility tool for use by a painter for scraping surfaces, cleaning rollers, and pulling nails. The utility tool lacks a convoluted surface for cleaning paint brushes, therefore requiring the painter to carry additional tools for completion of a repetitive painting activity related to cleaning painting utensils.

The prior tools for painters typically include edges for scraping paint off of surfaces, and for scraping paint off of paint roller tubes, or for prying cans open with the scraping edge. If various sized cans or other containers of paint are used by a painter, then multiple utility tools must be carried by the painter to accomplish the many operations that the painter must perform with one hand, while utilizing the other hand to hold onto a ladder or other platform during preparation for painting and cleanup of painting utensils.

Therefore, it is an object of the present invention to provide a hand-held tool having a plurality of uniquely configured surfaces for beneficial use by a painter.

It is another object of the present invention to provide an improved utility tool providing a plurality of indentations for cleaning multiple sizes of painting utensils.

It is another object of the present invention to provide a hand-held painter's tool having a multi-configured blade end for preparing surfaces for painting, and having multiple notches for cutting and opening a variety of containers.

It is another object of the present invention to provide an improved painter's tool for cleaning brushes and paint rollers, for opening multi-sized containers, and for preparing surfaces for painting.

BRIEF SUMMARY OF INVENTION

In accordance with the present invention, there is provided a painter's tool configured for providing multiple functions in one hand-held unit for use by a painter. The painter's tool provides elements for preparing a surface for painting, for cutting container seals and opening multi-sized paint containers, and for cleaning multiple shapes of painting utensils, with a plurality of elements oriented in a structural configuration that provides for efficient use of each individual element by a painter. The painter's tool includes a blade attached at a proximal end to a handle, with the blade including a distal end having a beveled scraper end being bounded by a squared corner and a pointed corner. The blade includes a first side surface having a plurality of teeth extending from the squared corner of the distal end, to the handle end of the blade. The plurality of teeth provide a convoluted surface for cleaning multiple sizes of paint brushes. The first side surface is angled outwardly from the handle end of the blade toward the squared corner of the distal end of the blade.

The blade includes a second side surface having an arcuate surface extended from the pointed corner, along a mid-portion that curves inwardly toward an axis midline of the blade in a concave shape, and ends at the handle end of the blade. The arcuate surface includes two opposed notches that are oriented to bound the inwardly curved mid-portion of the second side surface. The second side surface further includes a projection proximate the handle end of the blade, with the projection having a beveled edge. The second side surface additionally includes a trailing edge of the pointed corner that is beveled and sharpened, thereby providing a cutting edge for cutting materials and for prying into surfaces for removing cracked paint. The gripping end of the handle includes an end plate for setting nails into surfaces.

BRIEF DESCRIPTION OF SEVERAL VIEWS OF DRAWINGS

The above mentioned objects and advantages of the present invention are readily apparent from description of the invention contained herein, and by reference to the claims, read together with the drawings in which:

Figure 1:
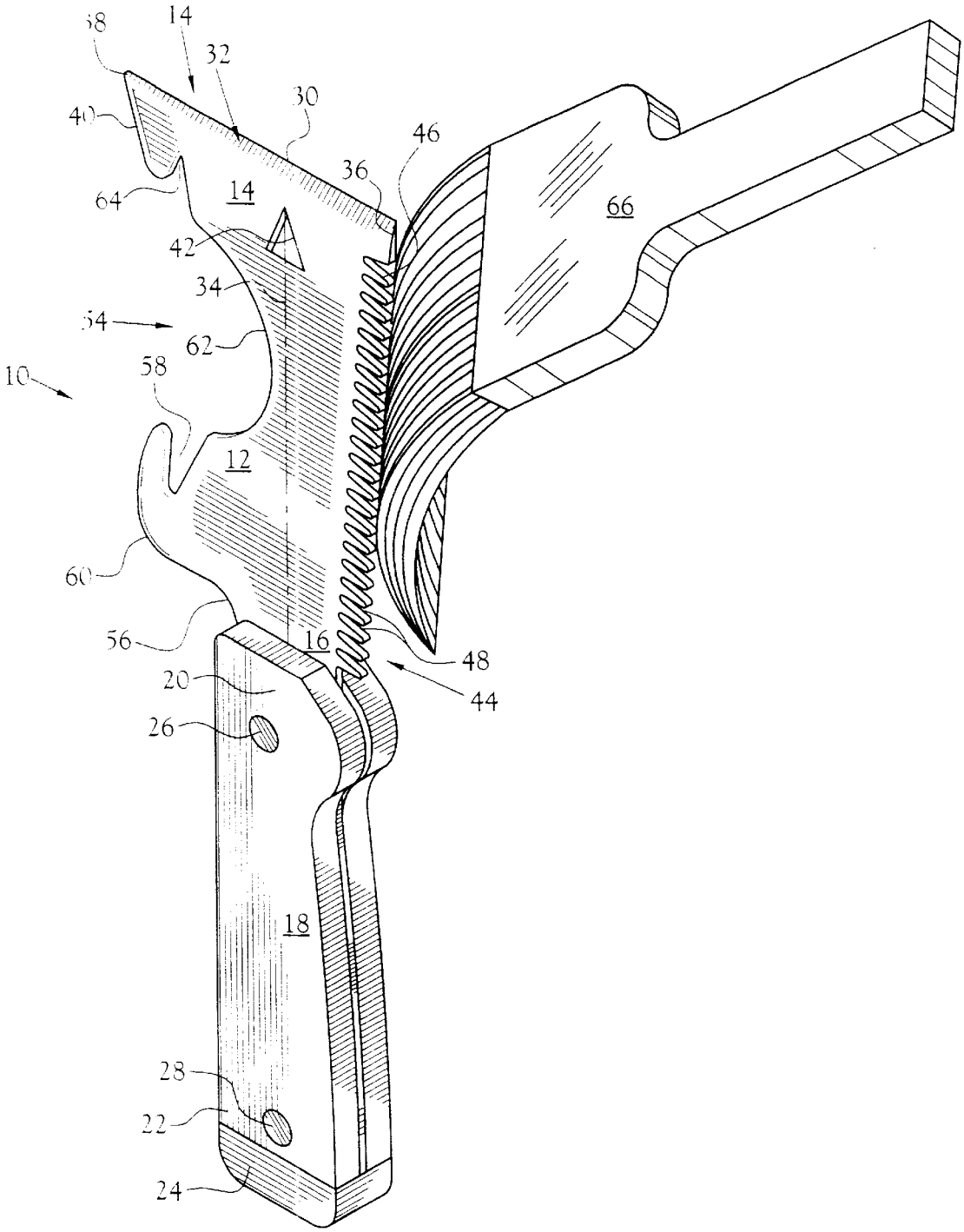
FIG. 1 is a side perspective view of one embodiment of the painter's tool, illustrating the plurality of features provided by the present invention.
Figure 3A:
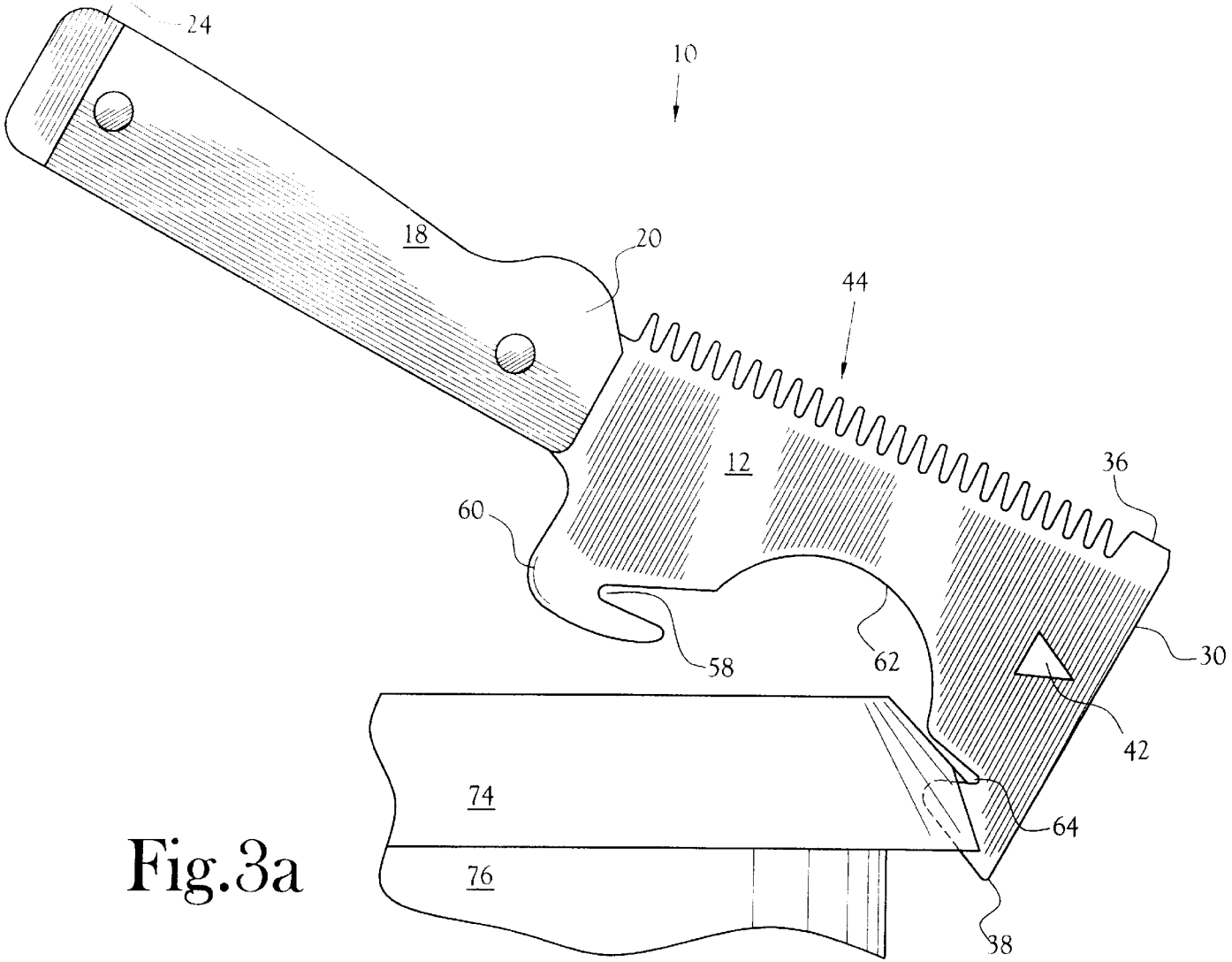
Figure 3B:
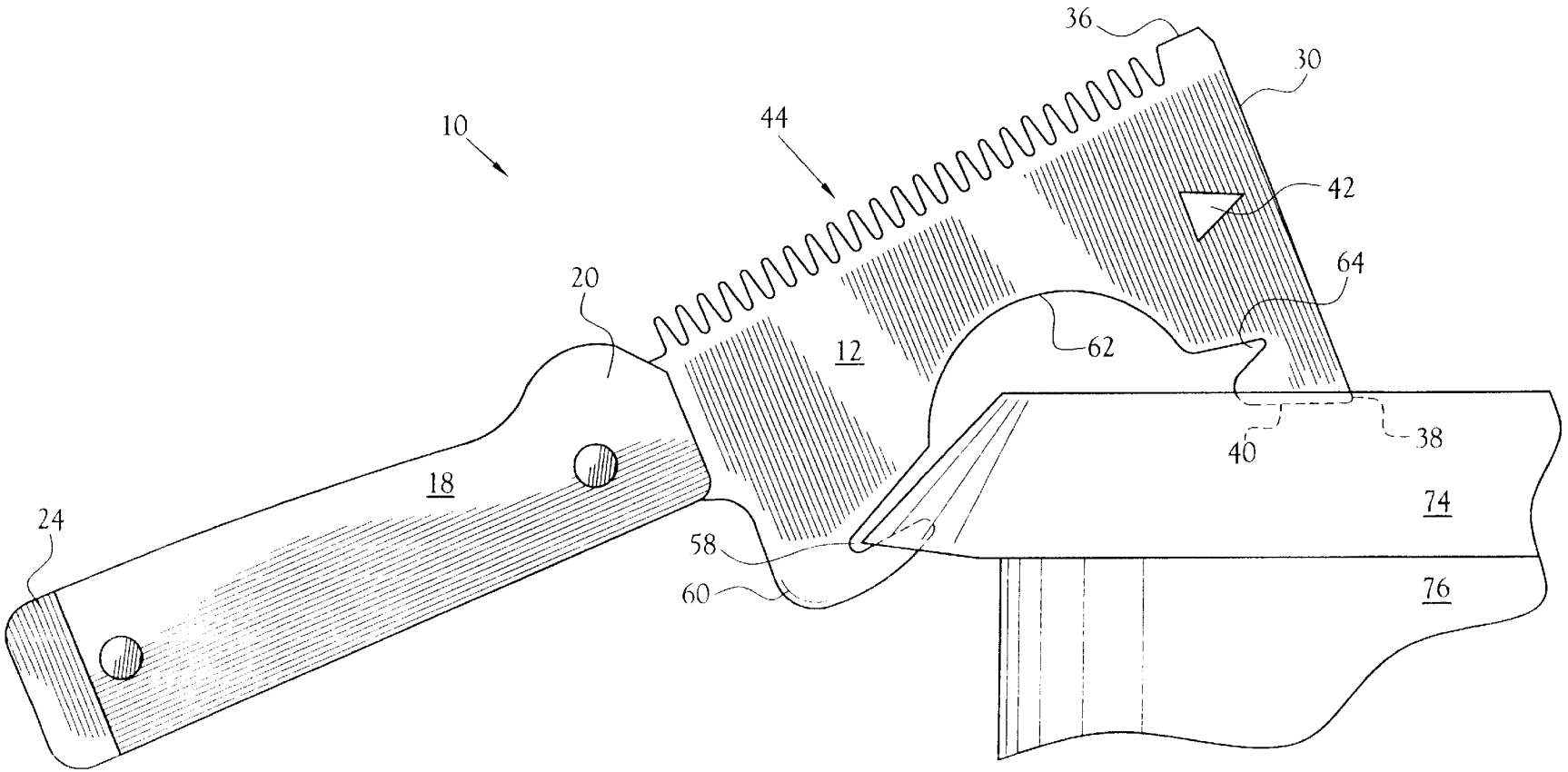

FIG. 3*a* is a side view of the painter's tool of FIG. 1 illustrating a second notch cutting a paint container lid; and FIG. 3*b* is a side view of the painter's tool of FIG. 3*a* illustrating a first notch applied against a paint container lid.

DETAILED DESCRIPTION OF THE INVENTION

In accordance with the present invention, there is provided a painter's tool configured for providing multiple functions in a hand-held unit for use by a painter in preparing surfaces for painting, for cutting container seals and opening multi-sized paint containers, and for cleaning multiple shapes of painting utensils, with about twelve elements oriented in a structural configuration that provides for efficient use of each individual element by a painter. As illustrated in FIG. 1, one embodiment of the painter's tool 10 includes a blade 12 having a distal end 14 for scraping and spreading of putty, and having a second end, or medial portion 16 shaped and sized to fit into a handle 18. The handle is generally rectangular in cross-section or an alternative shape to fit into the hand of the user, and includes a blade end 20 proximate the medial portion 16 of the blade, and includes an opposed second or base end 22 having a strike plate 24 with an appropriate sized and shaped end with a cross-section to be removably attachable to the base end 22. The strike plate 24 includes a flattened and hardened exterior end for striking and setting nails into a surface to be painted.

The medial portion 16 of the blade 12 inserts into the blade end 20 of the handle 18, with the blade 12 being removably fastened into the handle by connectors 26, 28 that are removably insertable through the handle 18. The connectors 26, 28 can be located along the longitudinal centerline of the handle 18. The painter's tool 10 is preferably of a length of about six inches to about nine inches extending from the distal end 14 to the exterior end of the strike plate 24. The handle 18 is sized at about four inches to about five inches in length, and shaped with a rectangular or a similar shape in cross-section to be easily grasped by a painter. The wider side portion of the handle 18 is oriented parallel with the wide portion of the blade 12 so that the painter's tool 10 can be inserted flat into a painter's pants pocket, or into an accessory belt pocket, or placed onto a belt hook to hang proximate the painter's accessory belt, or to hang from a ladder on which the painter is positioned. The blade 12 is preferably of a width of about two inches to about three inches across the distal end 14 of the blade 12. One embodiment of the painter's tool 10 provides a blade width at the distal end 14 of about two and a half inches, and a width of the handle 18 of about one inch, with an overall length from distal end 14 to strike plate 24 being about eight and a half inches.

The blade distal end 14 includes a generally straight edge 30 for spreading putty, and/or paint, and/or for scrapping dried paint off surfaces. One edge 32 of the distal end 14 can be beveled to provide a scraper side for removing excess dried and/or cracked paint from the surface to be painted. The beveled edge 32 of the straight edge 30 is bounded by a first corner 36 being generally configured as a squared corner, and a second corner 38 being generally configured as a pointed corner (see FIG. 1). The pointed second corner 38 provides the function of gouging putty and/or dried paint from cracks or small sized holes in the surface being painted, and the squared first corner 36 provides the function of gouging or routing out putty and/or dried paint from large sized holes in the surface being painted. The leading edge of the pointed second corner 38 and the leading edge of the squared first corner 36 are both contiguous with the beveled edge 32. An angled edge 40 is proximate the second corner 38 and is angled inwardly toward an axis or midline portion 34 of blade 12. The angled edge 40 is rounded at the distal end that joins with a second notch 64. The edge 40 can alternatively be beveled to provide a sharpened edge for cutting of tape or other materials utilized by a painter in preparing surfaces to be painted.

The midline 34 that bisects the blade 12 and is aligned generally with the lengthwise centerline of the handle 18. Proximate the midline 34 is positioned an opening 42 of a generally triangular or elongated shape. The opening 42 provides an elongated hole that can be utilized to remove nails or other projections from surfaces to be painted by inserting a nail head through the opening 42 and prying the nail out of the surface by manipulating the painter's tool by a leverage action with the distal end 14 as the fulcrum. The opening 42 can also provide a hole for attaching the blade 12 onto a hook or clip on the painter's belt (not shown) for convenient access by the painter while on a ladder or scaffolding.

Figure 2:
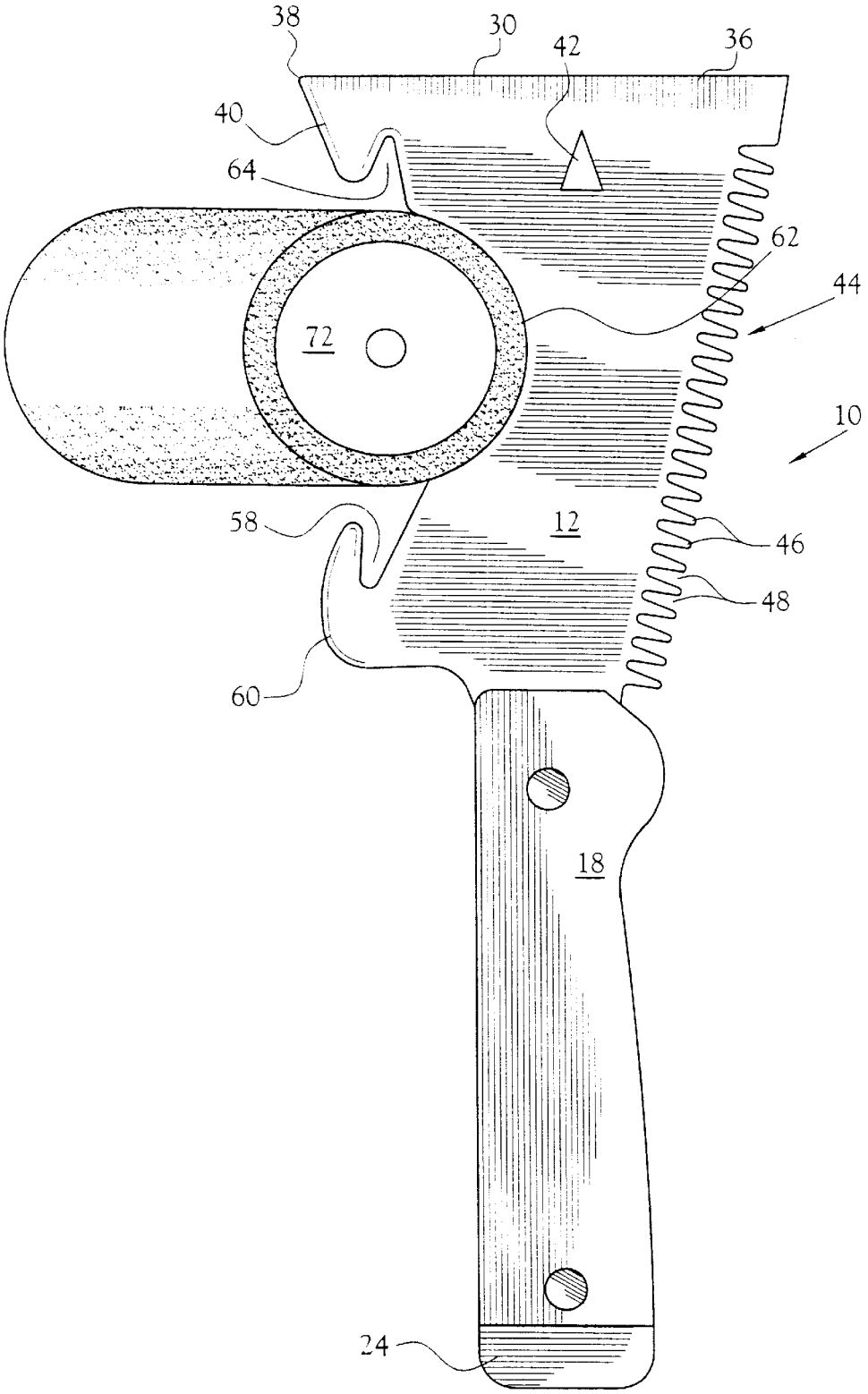
FIG. 2 is a side view of the painter's tool of FIG. 1 illustrating one side applied against a paint roller.

The blade 12 includes a first side 44 that can be generally straight as extended from the handle (see FIG. 1). One preferred embodiment provides first side 44 to be angled outwardly from the medial portion 16 of the blade to the squared first corner 36 of the blade 12 (see FIG. 2). The outwardly angled first side 44 provides additional structural integrity of the blade 12 by increasing the width at the straight edge 30 to accommodate a combination of features that are included in the blade along and between the first side 44 and a variably curved second side 54. The first side 44 is about three and a half inches to about four and a half inches in length from the blade end of handle portion 20, to squared first corner 36. First side 44 includes a plurality of teeth 46 of about three inches to about three and two-thirds in length from the blade end of handle portion 20, to about the trailing edge of squared first corner 36. Each respective tooth is about 1/sixteenth inch (about 0.0625 inch) in width, and each tooth is separated by indentations 48 that have a width of separation of about 1/sixteenth inch (about 0.0625 inch) between each tooth. The distance between each respective center of each tooth is about 0.125 inch to about 0.150 inch. The extension height of each tooth is about 1/fourth inch (about 0.25 inch), to about 1/half inch (about 0.5 inch), from the base of each tooth along the first side 44 of blade 12.

The plurality of teeth 46 provide a convoluted surface for removing excess paint from a paint brush 66 (see FIG. 1), and cleaning or straightening the bristles of the paint brush 66. Due to the orientation of the first side 44 being outwardly angled in relation to the midline 34 of the blade 12, the squared corner 36 extends outwardly above the extended longitudinal plane of the first side surface of the handle 18, thereby allowing a painter to grip the handle while providing leverage during gouging and manipulation of the squared corner 36 without bumping the painter's knuckles against the surface to be cleaned before painting. The outwardly angled first side 44 further provides for a painter to grip the handle in an ergonomic orientation while manipulating the plurality of plurality of teeth 46 for straightening and cleaning the bristles of a paint brush 66 (see FIG. 2).

A curved second side 54 includes a plurality of arcuate surfaces having a plurality of separate functions. An outwardly curved portion 56 projects from the medial portion 16 of blade 12, and away from the second side of handle 18 to allow a painter to grip the handle and maintain adequate clearance of the fingers or knuckles of the painter's hand away from the container 68 to be opened by projection 60 (see FIG. 3), and the paint roller 72 against which curved mid-portion 62 of second side 54 is maneuvered (see FIG. 2). Second side 54 includes, sequentially beginning at the medial portion 16 of the blade 12, the outwardly curved portion 56, a rounded projection 60 to be used as a prying tool, an angled notch portion 58 to be used as an opening tool to pry open rims of containers having overlapping lid covers such as a five gallon paint container, and a concave portion 62 that is generally curved inwardly toward the midline 34 and is used as a paint roller cleaning tool. The second side 54 further extends outward from the concave portion 62 to a second notch 64 having interior beveled edges that are used as a cutting tool for a container top seal 74 of a container lid (see FIG. 3*a*). The interior side edges of notch portion 64 are beveled and sharpened for use as a container seal cutter. Positioned between the inwardly angled edges of second notch 64 and the pointed second corner 38 is the angled edge 40 that provides an edge for use in removing or inserting connectors, and applying leverage against items to be opened by a painter.

The angled notch portion 58 provides the painter's tool 10 with the ability to pry open a five gallon paint container 76 having a overlapping lid seal 74 that is cut by second notch portion 64 (see FIG. 3*a* and 3*b*). The combination of angled notch portion 58 and the second cutting notch 64 provides for dual purpose, cutting and prying notches on either side of a curved concave portion 62 that eliminates the need for separate tools to utilized to separately cut a heavy plastic lid seal 74, to pry open a five gallon paint container 76, and to clean a paint roller 72, therefore simplifying the number of tools that a painter must carry while working.

The concave portion 62 is curved at about a ¾ inch radius arc (about 0.875 inch radius), to provide adequate curvature for the middle portion of blade 12 to clear the upper portion of the seal 74 when the angled notch portion 58 is applied against, and levers off the seal 74 (see FIG. 3*b*) while the second corner 38 is placed against a surface of the top of container 76 which can be a five gallon sized plastic bucket of paint or caulking, or larger sized container. The concave portion 62 radius arc serves at least two purposes, namely to provide clearance for the prying motion of the angled notch portion 58 levered against the seal 74 of a container lid, and to clean a paint roller 72.

The projection 60 provides a rounded edge that can provide a reinforced can opener projection 60 to pry open any sized large, medium, or small volume container having a can top rim depressed into a circumferential upper cylindrical trough of the container (not shown). The projection 60 can have side edges that are beveled for use as a screw driver to insert connectors or fasteners into the surface to be painted. The combination of the angled notch portion 58 and the projection 60 provides an additional usefulness of a can opener and/or bottle opener positioned close to the medial portion 16 of blade 12 to provide a means for efficient application of leverage by the painter when holding the handle 18 and attempting to open a container such as a paint can or bottle. The concave portion 62 provides a paint roller cleaning means for removal of paint or unwanted contaminants from a paint roller 72 (see FIG. 2).

The multi-purpose painter's tool 10 (see FIG. 1) provides between eleven and twelve functions in one hand-held unit for use by a painter. The functions of the painter's tool 10 include: (a) the nail strike plate 24 providing a hammer function; (b) the beveled edge 32 providing a scraper of dried paint and putty; (c) the non-beveled edge opposite beveled edge 32 providing a spreader of caulking; (d) the pointed corner 38 providing a gouger of cracks and small holes; (e) the squared corner 36 providing a gouger function and a means for screwing connectors onto surfaces; (f) the angled edge 40 providing a cutting edge; (g) tile opening 42 for pulling nails and staples or for attaching the blade to a hook on the painter's belt; (h) the plurality of teeth 46 providing a brush cleaning and bristle straightening means; (i) the angled notch portion 58 providing a container opener; 0) the beveled sides of second notch 64 providing a container lid seal cutter due to the interior edges of second notch 64 being beveled and sharpened for cutting; (k) the projection 60 providing a lever for prying open container cans and a means for screwing screws and connector; and (l) the concave portion 62 providing a roller cleaning means. Therefore, the compact configuration of the elements along the perimeter of the blade 12, plus the nail puller 42 and nail strike plate 24, provides a painter's tool 10 that is conveniently carried in a pocket of the painter, and reduces the need for the painter to carry additional tools other than the painter's tool 10, a paint brush 66, and/or a paint roller, and a paint container while painting on a ladder or scaffolding.

One embodiment includes a painter's tool including a blade 12 having a first side 44 that can be generally straight as extended from the handle (see FIG. 1), with the plurality of teeth 46 having rounded teeth ends to minimize the cutting of paint brush bristles when the paint brush 66 is moved across the plurality of teeth 44. An alternative embodiment provides a first side 44 being angled outwardly from the medial portion 16 of the blade to the squared first corner 36 of the blade 12 (see FIG. 2). The outwardly angled first side 44 provides additional structural integrity of the blade 12 by increasing the width at the straight edge 30 to accommodate a combination of features that are included in the blade along the outer edges and between the first side 44 and the second side 54. The outwardly angled first side 44 allows for a painter to hold the painter's tool 10 in one hand, while manipulating a painting utensil across the first side 44 at an angle of less that a right angle (90°) of the hand holding the painting utensil, therefore maintaining an ergonomic preferred orientation between the painting utensil and the painter's tool held in separate hands while manipulating the plurality of teeth 46 for straightening and cleaning the bristles of a paint brush 66.

From the foregoing description, additional advantages over the prior devices will be recognized by those skilled in the art for the improved painter's tool of the present invention. While a preferred embodiment is shown and described, it will be understood it is not intended to limit the disclosure of the invention, but rather it is intended to cover all modifications and alternate devices and methods of operating falling within the spirit and scope of the invention as defined in the appended claims.

What is claimed is:

1. A utility tool for use by a painter for preparation of a surface to be painted and cleaning of a painting accessory, comprising:

a blade having a first end, a second end, and an axis extended along said blade between said first end and said second end, said first end defining a scraper edge bounded by a first corner and a second corner, said blade includes an opening therethrough;

a handle having a base end and a blade end, said blade end of said handle attached to said second end of said blade;

a first side of said blade extended from said second end of said blade to said first corner of said first end of said blade;

a second side opposed to said first side, said second side extended from said second end of said blade to said second corner of said blade, said second side having a mid-portion curved inwardly toward said axis, said curved mid-portion having a distal curved portion proximate said second corner and a proximal curved portion proximate said second end of said blade, said curved mid-portion having a curvature to accommodate a portion of a paint roller perimeter against said curved mid-portion;

a notch recessed into said second side, said notch positioned at said distal curved portion of said curved mid-portion of said second side, said notch having at least one interior edge being beveled; and a projection positioned between said proximal curved portion of said curved mid-portion and said second end of said blade, said projection curved outwardly from said axis of said blade.

2. The utility tool according to claim 1, wherein said first side including a plurality of teeth extending along said first side, whereby said plurality of teeth is utilized to clean a paint brush contacted against said plurality of teeth.

3. The utility tool according to claim 1, wherein said scraper edge further including said scraper edge beveled on one side, said beveled scraper edge bounded by said first corner being squared and said second corner being pointed, said second corner having a trailing side angled inwardly toward said axis of said blade, said trailing side positioned between said second corner and said curved mid-portion, said trailing side having a sharpened edge.

4. The utility tool according to claim 1, wherein said second side of said blade further including an angled notch recessed into said second side, said angled notch positioned between said proximal curved portion of said curved mid-portion and said projection of said second side of said blade, said angled notch having a first interior edge oriented generally parallel with said axis of said blade and having a second interior edge being angled generally toward said inwardly curved mid-portion of said blade.

5. The utility tool according to claim 1, wherein said base end of said handle further including having a strike plate removably attachable to said base end.

6. The utility tool according to claim 1, wherein said opening therethrough said blade further includes said opening positioned along said axis of said blade, said opening proximate said first end of said blade.

7. The utility tool according to claim 2, wherein said first side further includes a generally straight edge extended from said first corner of said first side to said plurality of teeth extending along said first side of said blade.

8. A utility tool for use by a painter for preparation of a surface to be painted, comprising:

a blade having a first end, a second end, and an axis extended along said blade between said first end and said second end, said first end defining a scraper edge bounded by a first corner and a second corner, said blade includes an opening therethrough;

an elongated handle having a base end and a blade end, said blade end attached to said second end of said blade;

a first angled side extended outwardly from said second end of said blade toward said first end of said blade, whereby said first angled end of said blade is wider than said second end of said blade, said first angled side including a plurality of teeth extending along said first angled side;

a second side opposed said first angled side of said blade, said second side having a curved mid-portion curved inwardly toward said axis of said blade, said curved mid-portion having a distal curved portion proximate said second corner and a proximal curved portion proximate said second end of said blade, said curved mid-portion having a curvature to accommodate a portion of a paint roller perimeter against said curved mid-portion; and a projection positioned between said curved mid-portion and said second end of said blade, said projection curved outwardly from said axis of said blade.

9. The utility tool according to claim 8, wherein said second side further including a distal and a proximal notch recessed into said second side, said distal notch positioned between said second corner and said distal curved portion of said curved mid-portion; said proximal notch positioned between said proximal curved portion of said curved mid-portion and said second end of said blade, said distal notch having interior edges being beveled on at least one side of each of said interior edges, whereby said mid-portion is bounded by said distal notch and proximal notch.

10. The utility tool according to claim 8, wherein said second end of said handle further including having a strike plate removably attachable to said second end.

11. The utility tool according to claim 8, wherein said opening therethrough said blade further includes said opening positioned along said axis of said blade, said opening proximate said first end of said blade.

12. The utility tool according to claim 8, wherein said scraper edge further including said scraper edge beveled on one side, said beveled scraper edge bounded by said first corner being squared in shape, and said second corner being pointed in shape, said second corner having a trailing side angled inwardly toward said axis of said blade, said trailing side positioned between said second corner and said distal curved portion of said curved mid-portion, said trailing side having a sharpened edge.

13. A painter's tool for use by a painter for preparation of a surface to be painted and to clean paint brushes and paint rollers, comprising:

a blade having a first end, a second end, and an axis extended along said blade between said first end and said second end, said first end defining a scraper edge beveled on one side of said scraper edge, said beveled scraper edge bounded by a first corner and a second corner, whereby said beveled scraper edge is utilized to scrape the surface to be painted, said blade includes an opening therethrough;

an elongated handle having a base end and a blade end, said blade end attached to said second end of said blade, and said base end having a strike plate removably attachable to said second end, whereby said strike plate is utilized to set a nail into the surface to be painted;

a first side extended from said second end of said blade to said first end of said blade, whereby said first end of said blade is wider than said second end of said blade, said first side having a plurality of teeth extending along said first side, whereby said plurality of teeth is utilized to clean a paint brush;

an arcuate side opposite said first side of said blade, said arcuate side having a curved mid-portion curved inwardly toward said axis of said blade, said curved mid-portion having a distal curved portion proximate said second corner and a proximal curved portion proximate said second end of said blade, said curved mid-portion having a curvature to accommodate a portion of a paint roller perimeter against said curved mid-portion; and a projection positioned between said curved mid-portion of said second and said second end of said blade, said projection curved outwardly from said axis of said blade, said projection having one side being beveled.

14. The painter's tool according to claim 13, wherein said opening therethrough said blade further includes said opening positioned along said axis of said blade, said opening proximate said first end of said blade.

15. The painter's tool according to claim 13, wherein said second corner includes a pointed corner having a trailing side angled inwardly toward said axis of said blade, said trailing side positioned between said second corner and said curved mid-portion, said trailing side having a sharpened edge.

16. The painter's tool according to claim 13, wherein said arcuate side further including a distal notch and a proximal notch recessed into said arcuate side, said distal notch positioned between said second corner and said distal curved portion of said curved mid-portion; said proximal notch positioned between said proximal curved portion of said curved mid-portion and said second end of said blade, said distal notch having interior edges being beveled on at least one side of each of said interior edges, whereby said curved mid-portion is bounded by said distal notch and proximal notch.

17. A utility tool for use by a painter, comprising:

a blade having a first end, a second end, and an axis extended along said blade between said first end and said second end, said first end defining a scraper edge bounded by a first corner and a second corner, said blade including an opening therethrough, said opening positioned along said axis of said blade, said opening proximate said first end of said blade;

a handle removable attached to said second end of said blade;

a first side of said blade extended from said second end of said blade to said first corner of said first end of said blade;

a second side of said blade extended from said second end of said blade to said second corner of said first end of said blade, said second side having a mid-portion curved inwardly toward said axis of said blade;

said second side of said blade further including an angled notch and a second notch recessed into said second side, said angled notch positioned between said proximal curved portion of said curved mid-portion and said second end of said blade, said second notch positioned between said second corner of said distal end and said distal curved portion of said curved mid-portion; said second notch having interior side edges being beveled on at least one side of each of said interior side edges, whereby said mid-portion is bounded by said angled notch and second notch; and a plurality of teeth extending along said first side, whereby said plurality of teeth being utilized to clean a paint brush contacted against said plurality of teeth.

18. The utility tool according to claim 17, wherein said second side of said blade including said curved mid-portion having a distal curved portion proximate said second corner and a proximal curved portion proximate said second end of said blade, said curved mid-portion having a curvature to accommodate a portion of a paint roller perimeter against said curved mid-portion, said second side further including a projection positioned between said proximal curved portion of said second side and said second end of said blade, said projection curved outwardly from said axis of said blade, said projection having one side being beveled.

19. The utility tool according to claim 17, wherein said scraper edge including said scraper edge beveled on one side, said beveled scraper edge bounded by said first corner being squared, and said second corner being pointed, said second corner having a trailing side angled inwardly toward said axis of said blade, said trailing side positioned between said second corner and said curved mid-portion, said trailing side having a sharpened edge.

20. The utility tool according to claim 17, wherein said second side of said blade further including said angled notch being utilized to pry open container lid covers; and said second notch having beveled interior side edges being sharpened on at least one side of each of said interior side edges, whereby said interior side edges of second notch being used as a container seal cutter.

21. The utility tool according to claim 17, wherein said handle including a blade end and a second end having a strike plate removably attachable to said second end of said handle.

* * * * *